United States Patent [19]

Lane

[11] Patent Number: 4,709,518

[45] Date of Patent: Dec. 1, 1987

[54] UNIVERSAL FASCIA ASSEMBLY FOR SECURING A MEMBRANE TO A ROOF

[76] Inventor: Bennie L. Lane, W347 S7194 Sprague Rd., Eagle, Wis. 53119

[21] Appl. No.: 922,242

[22] Filed: Oct. 23, 1986

[51] Int. Cl.[4] ..... E04D 13/15

[52] U.S. Cl. ..... 52/94

[58] Field of Search ..... 52/23, 94, 95, 11, 15, 52/16, 58–60, 96

[56] References Cited

U.S. PATENT DOCUMENTS

| | | | |
|---|---|---|---|
| 2,646,011 | 7/1953 | Ager | 52/15 |
| 3,365,847 | 1/1968 | Josek | 52/94 |
| 3,389,515 | 6/1968 | Hellebrand | 52/96 |
| 3,404,495 | 10/1968 | Simpson | 52/96 |
| 3,405,485 | 10/1968 | Edwards | 52/60 |
| 3,432,976 | 3/1969 | Berg | 52/60 |
| 3,444,658 | 5/1969 | Gobel | 52/94 |
| 3,507,470 | 4/1970 | Gobel | 52/94 |
| 3,680,269 | 8/1972 | Fischer et al. | 52/94 |
| 3,774,364 | 11/1973 | Johnson | 52/23 |
| 3,815,302 | 6/1974 | Monroe | 52/94 |
| 4,037,372 | 7/1977 | Patry | 52/96 |
| 4,083,158 | 4/1978 | Wolma | 52/300 |
| 4,419,850 | 12/1983 | Butzen | 52/60 |
| 4,437,283 | 3/1984 | Benoit | 52/410 |
| 4,472,913 | 9/1984 | Hickman | 52/96 |
| 4,519,172 | 5/1985 | Ristow | 52/96 |
| 4,543,758 | 10/1985 | Lane | 52/410 |
| 4,549,376 | 10/1985 | Hickman | 52/94 |
| 4,574,544 | 3/1986 | Harris | 52/23 |

*Primary Examiner*—James L. Ridgill, Jr.

*Attorney, Agent, or Firm*—Michael, Best & Friedrich

[57] ABSTRACT

An anchor assembly for securing a rubber membrane against the surface of a roof, the anchor assembly including a rigid plate adapted to be secured to the generally vertical edge portion of the roof and to clampingly engage a portion of the rubber membrane. The anchor assembly also includes a support plate supported by a flange projecting from a forward face of the plate. A cover plate has an upper edge engaging an upper edge of the support plate and a lower edge resiliently engaging a lower edge of the rigid plate.

7 Claims, 8 Drawing Figures

UNIVERSAL FASCIA ASSEMBLY FOR SECURING A MEMBRANE TO A ROOF

FIELD OF THE INVENTION

The invention relates to rubber roof membranes and to apparatus for use in securing rubber roof membranes in place.

RELATED APPLICATIONS

Attention is directed to applicant's copending application, U.S. patent application Ser. No. 862,463 filed May 12, 1986, a continuation-in-part of U.S. patent application Ser. No. 796,290, filed Nov. 8, 1985 and now abandoned.

BACKGROUND PRIOR ART

Large rubber membranes are commonly used for covering a roof such as a flat roof. Such rubber membranes may be laid over the surface of the roof and secured in place by adhesive or mechanical fastening means. An example of a suitable fastening means for securing a membrane in place is described in the Lane U.S. Pat. No. 4,543,758 issued Oct. 1, 1985.

Prior art mechanisms have also been provided for securing the edges of a rubber roof membrane in place to the edges of the roof. One apparatus for securing a membrane in Place is described in the Butzen U.S. Pat. No. 4,419,850, issued Dec. 13, 1983.

In some applications the rubber membrane may be subjected to large wind forces causing the rubber membrane to tend to pull away from the surface of the roof, and in these applications, it is necessary to provide a means for rigidly securing the edge of the rubber membrane in place to prevent the edge of the membrane from pulling away from the edge of the roof.

In some applications the rubber membrane may be exposed or it may be covered with layers of smooth stones or ballast. The weight of the layer of ballast on the membrane is intended to hold the membrane down against the roof surface. In other applications the rubber membrane may be held down against the surface of the roof by placing cast paver blocks on the membrane. The paver blocks generally comprise cast square concrete blocks, approximately 1½ to 2 inches thick and 2 feet wide. The paver blocks are placed on the membrane in edge-to-edge relation and cover at least that portion of the membrane adjacent the edge of the roof. While these paver blocks are relatively heavy, in some applications the wind forces against the building and the airflow over the edge of the roof may tend to lift the edges of the paver blocks which are adjacent the edge of the roof. This can result in damage to the paver blocks, and movement of the paver blocks on the membrane can cause the peripheral edges of the paver blocks or sharp edges created by fracture of the paver blocks, to cut or abraid the rubber membrane.

Attention is also directed to the Wolma U.S. Pat. No. 4,083,158, issued Apr. 11, 1978; the Berg U.S. Pat. No. 3,432,976, issued Mar. 18, 1969; the Gobel U.S. Pat. No. 3,444,658, issued May 20, 1969; and the Gobel U.S. Pat. No. 3,507,470, issued Apr. 21, 1970.

Attention is also directed to the Fisher, Jr. U.S. Pat. No. 3,680,269, issued Aug. 1, 1972; the Monroe U.S Pat. No. 3,815,302, issued June 11, 1974; the Simpson U.S. Pat. No. 3,404,495, issued Oct. 8, 1968; the Patry U.S. Pat. No. 4,307,372, issued July 26, 1977; and the Hellebrand U.S. Pat. No. 3,389,515, issued June 25, 1968.

SUMMARY OF THE INVENTION

The present invention provides an improved apparatus for securing the periphery of a rubber membrane to the edge of a roof such that the rubber membrane is firmly clamped in place against the surface of the roof and will not pull away as a result of wind forces on the membrane. Additionally, the present invention provides apparatus which is adapted for use in a variety of different applications for effectively securing the rubber membrane to the roof.

Various other features and advantages of the invention will be apparent by reference to the following description of a preferred embodiment, from the claims and from the drawings.

BRIEF DESCRIPTION OF THE DRAWINGS

FIG. 5 is a cross section view similar to FIGS. 2 and 4 and showing an alternative embodiment of the invention.

Figure 1:
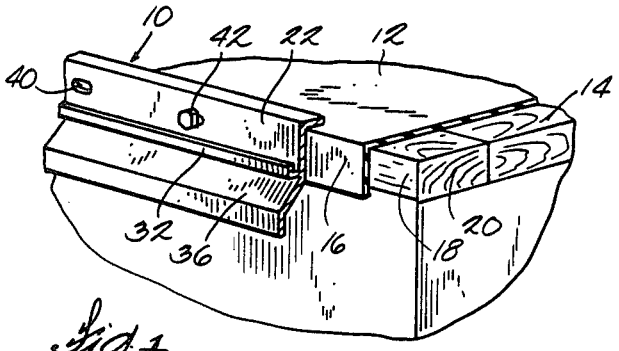
FIG. 1 is a perspective view of a universal membrane anchor bar embodying the present invention and shown securing the edge of a rubber membrane to the edge of a roof.

Before explaining one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 is an anchor bar 10 adapted to secure the edge of a rubber membrane 12 to the surface 14 of a flat roof. The rubber membrane 12 is supported by the flat generally horizontal upper surface 14 of a roof, and an edge 16 of the membrane 12 extends over the vertical face 18 of a conventional wooden nailer 20 of the roof and such that the projecting or extending portion 16 of the membrane 12 can be secured against the vertical face 18 of the nailer 20.

The anchor bar 10 is adapted to extend along the length of the edge of the roof and to secure the rubber membrane 12 to the nailer 20 and to thereby prevent the edge of the rubber membrane 12 from pulling upwardly away from the edge of the roof. The anchor bar 10 comprises an elongated rigid planar vertical portion 22 including a generally planar rearward surface 24 adapted to engage that portion 16 of the rubber membrane folded over the edge of the roof and for clamping that portion of the membrane securely against the vertical face or surface 18 of the nailer 20. In the illustrated arrangement, the upper edge 26 of the planar vertical portion 22 includes an integral rearwardly projecting rib or flange 28. The rearwardly projecting flange 28 includes a lower surface 30 adapted to engage the rubber membrane 12 and to clamp it downwardly against the upper surface of the nailer 20 such that the rubber membrane cannot be pulled upwardly away from the surface of the roof.

The anchor bar 10 further includes a flange 32 projecting from the forward face of the planar vertical portion 22 and intermediate the upper and lower edges of the anchor bar. The flange 32 extends along the length of the anchor bar in parallel relation to the upper and lower edges of the anchor bar. The flange 32 includes a projecting end defining an upwardly extending lip 34. The lip 34 and the forward face of the anchor bar define a groove extending along the length of the anchor bar.

The anchor bar 10 further includes a downwardly extending flange portion 36 inclined forwardly away from the vertical face of the edge of the roof and defining a lower edge 38 which is spaced outwardly from the face of the roof.

In a preferred form of the invention, the anchor bar 10 can be conveniently manufactured as an elongated aluminum extrusion, and such that the anchor bar comprises a rigid structure wherein both the rearwardly extending flange 28 and the forwardly extending flange 32 are substantially inflexible with respect to the vertical plate portion 22 of the anchor bar such that the forces of the wind on the anchor bar will not cause deflection of the flange 28 or movement of the anchor bar 10 away from the edge of the roof.

Means are also provided for securing the anchor bar 10 to the edge of the roof such that that portion 16 of the membrane extending over the edge of the roof will be clamped in place by the anchor bar 10. The means for securing the anchor bar in place also causes the flange portion 28 of the anchor bar 10 to clamp the membrane downwardly against the surface of the roof.

While the means for securing the anchor bar in place could have various constructions, in the illustrated arrangement a plurality of apertures or slots 40 are provided through the vertical plate portion 22. The apertures 40 are spaced apart along the length of the anchor bar such that fasteners, such as screws 42, can extend through the apertures 40 to rigidly secure the anchor bar 10 to the wooden nailer 20.

Figure 2:
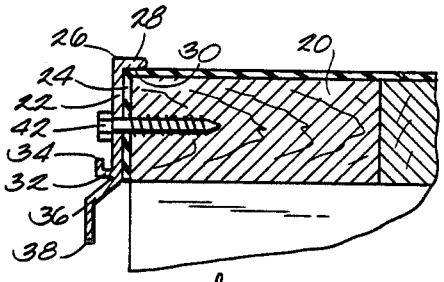
FIG. 2 is a cross section elevation view of the anchor bar shown in FIG. 1.

When the anchor bar is in place, as illustrated in FIG. 2, the lower surface 30 of the rearwardly extending flange 28 clamps the edge of the rubber membrane downwardly against the upper surface of the wooden nailer, and the rearward face 24 of the vertical plate portion 22 of the anchor plate similarly clamps the downwardly extending edge 16 of the rubber membrane firmly against the vertical planar face 18 of the wooden nailer 20. The anchor bar 10 thus provides a very rigid and secure mechanism for clamping the rubber membrane 12 against the surface of the roof without providing holes in the membrane above the edge of the roof and also provides a means for securing a rubber membrane in place which is very resistent to even large upward forces on the membrane which might be caused by high winds.

Figure 3:
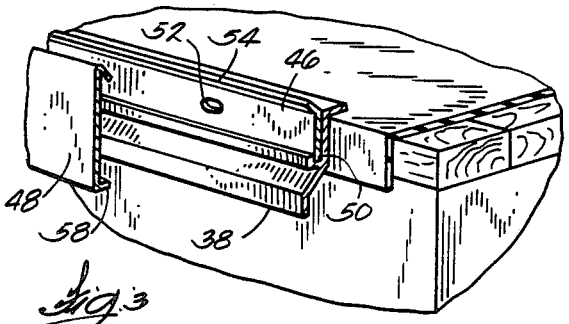
Figure 4:
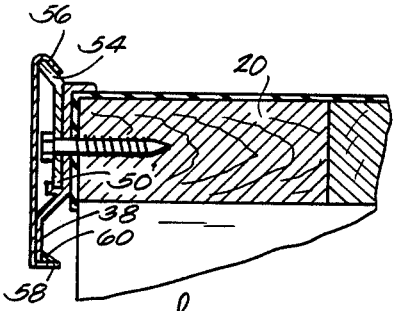
FIG. 4 is a cross section view of the apparatus illustrated in FIG. 3.

Illustrated in FIG. 3 is a second embodiment of the apparatus embodying the invention and includes in combination, an anchor bar 10 as illustrated in FIGS. 1 and 2, and a support plate 46 supported by the anchor bar 10 and for use in combination with the anchor bar 10 for supporting a cover plate or face plate 48. The support plate 46 comprises an elongated generally planar plate having a lower edge 50 adapted to be housed in the groove defined by the flange 32. The support plate 46 also includes a plurality of spaced apart linear slots 52 adapted to be aligned with the slots 40 provided in the anchor bar 10 such that screws 42 or other fasteners can extend through the support plate 46 and the anchor bar 10 to thereby secure the support plate firmly against the anchor bar and the anchor bar to the wooden nailer 20. The upper edge 54 of the support plate 46 projects upwardly and forwardly, and the face plate 48 includes a curved upper edge portion 56 adapted to hook over the upper edge 54 of the support plate. The face plate 48 also includes a lower flange 58 adapted to be forced over the lower edge 38 of the anchor bar 10 and to snap into place to engage the lower edge of the anchor bar. In a preferred form of the invention the face plate 48 is comprised of a relatively flexible material such as sheet metal. The lower flange 58 is sufficiently resilient that it can be forced over the lower edge 38 of the anchor bar whereby it will resiliently snap into place and grip the lower edge 38 of the anchor bar 10 to prevent removal of the face plate. In the illustrated arrangement, the projecting end of the flange 58 of the lower portion of the face plate 48 also includes a lip 60 (FIG. 4) which is folded over such that as the flange 58 is forced over the lower end 38 of the anchor bar, the edge of the lip 60 will engage the rearward surface of the downwardly extending flange 38 to prevent removal of the face plate 48.

Figure 5:
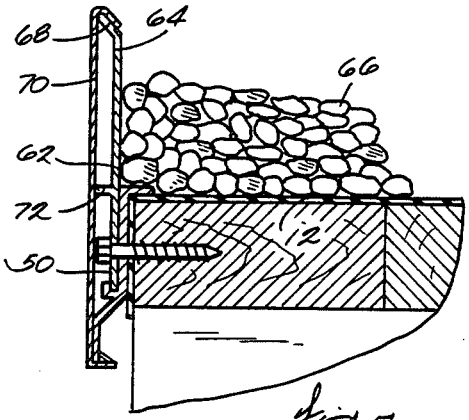
FIG. 5 is an exploded perspective view of an alternative embodiment of the apparatus illustrated in FIGS. 1–2.

Illustrated in FIG. 5 is another alternative embodiment of the invention. The anchor bar 10 supports a gravel stop plate 62 comprising an elongated rigid plate having a lower edge 50 adapted to be housed in the groove provided by the flange 32 of the anchor bar 10. The gravel stop plate also includes an upper portion 64 adapted to project upwardly with respect to the surface 14 of the roof and functional to retain gravel or ballast 66 supported by the membrane 12. In the arrangement illustrated in FIG. 5, the upper edge 68 of the gravel stop plate 62 is inclined upwardly and forwardly to engage a curved upper portion 56 of a decorative cover plate or face plate 70. In the embodiment shown in FIG. 5, the gravel stop plate 62 also includes an elongated rib 72 projecting forwardly from the forward face of the gravel stop plate, the elongated rib 72 being intended to provide a means for supporting the face plate 70 intermediate its upper and lower edges.

Figure 6:
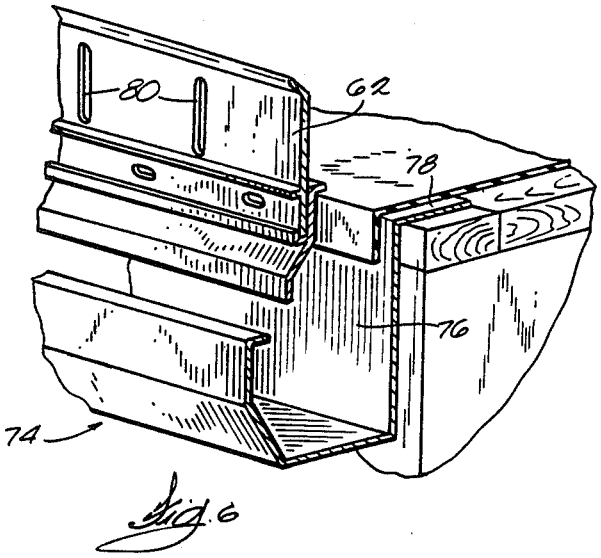
FIG. 6 is a perspective view of another alternative embodiment of the invention.
Figure 7:
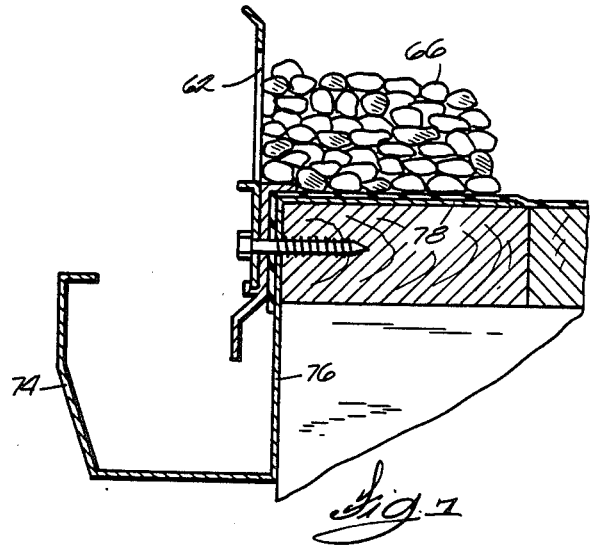
FIG. 7 is a cross section view of the apparatus shown in FIG. 6.

Illustrated in FIGS. 6 and 7 is another alternative embodiment of the invention illustrating the anchor bar 10 and a gravel stop plate 62 in combination with a gutter 74, and shown as providing a means for securing the gutter 74 to the edge of the roof while also providing a means for clamping the edge 16 of the rubber membrane 12 securely against the edge 18 of the roof. In the illustrated construction, the gutter 74 is comprised of sheet metal and includes a vertical wall portion 76 adapted to be positioned against the vertical face of the edge of the roof and nailer 20 and a transverse flange portion 78 adapted to be supported on the upper surface of the wooden nailer 20 beneath the rubber membrane 12. The anchor bar 10 and gravel stop plate 62 are secured to the wooden nailer 20 by fasteners 42 which extend through the apertures 52 and 40 in the gravel stop plate and anchor bar 10, respectively, and through the vertical wall portion 76 of the gutter. The fasteners 42 thus also function to securely anchor the gutter 74 to the edge of the roof and to hold it in place.

In the embodiment illustrated in FIGS. 6 and 7 the gravel stop plate 62 is also provided with a plurality of vertical slots 80 spaced apart along the length of the gravel stop plate. The elongated slots 80 function to permit water to drain from the roof into the gutter 74 while the gravel plate also functions to restrain the ballast 66 on the membrane.

Figure 8:
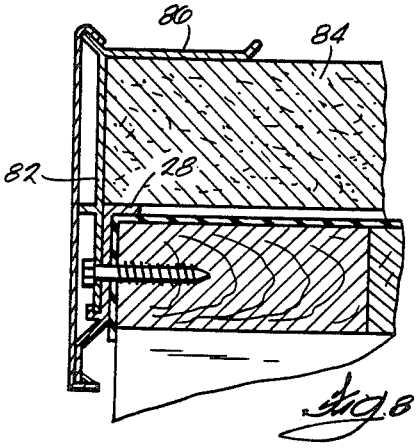
FIG. 8 is a cross section view like FIGS. 2, 4 and 7 and showing an alternative embodiment of the invention.

Illustrated in FIG. 8 is another alternative embodiment of the invention wherein a gravel stop plate or support plate 82 is further provided with a means for securing a paving block 84 in place on the membrane 12 and for preventing winds at the edge of the roof from lifting the edge of the paving block 84 upwardly away from the membrane 12. In the arrangement shown in FIG. 8 the support plate 82 includes an integral flange 86 extending rearwardly from an upper edge of the support plate and parallel to the rearwardly extending flange 28 integrally attached to the anchor bar 10. In installation of a rubber membrane 12 and when employing the apparatus shown in FIG. 8, the edge 16 of the rubber membrane 12 is laid over the edge of the roof, and then the anchor bar 10 is used to clamp the edge of the membrane against the edge of the roof. The edge of the paving blocks 84 can then be slideably inserted under the flange 86 of the support plate 82 and properly positioned on the rubber membrane. The rearwardly extending flange 86 of the support plate 82 will hold the edge of the paving block 84 down against the rubber membrane 12 and prevent wind forces at the edge of the roof from lifting the edge of the rubber membrane.

As illustrated by reference to FIGS. 1–8 one of the advantages of the invention is that the anchor bar 10 can be used in a plurality of applications and is functional with or without the use of a decorative face plate and in supporting a number of various support plate constructions.

Various features of the invention are set forth in the following claims.

I claim:

1. Apparatus for securing a rubber membrane to a roof, the roof having an upper surface and the edge of the roof defining a generally vertical surface, the rubber membrane being supported by the upper surface of the roof, and a portion of the membrane extending downwardly adjacent the vertical surface of the edge of the roof, the apparatus comprising:

an elongated membrane anchor bar adapted to extend along the edge of the roof, said anchor bar including a generally planar portion having a rearward surface adapted to secure said portion of the membrane against the vertical surface of the edge of the roof, said anchor bar including an upper edge portion and a lower edge portion, a first flange integrally joined to said upper edge portion of said anchor bar and projecting rearwardly with respect to said rearward surface, said first flange having a generally planar downwardly facing lower surface adapted to engage a planar upper surface portion of the membrane to secure a portion of the membrane downwardly against the upper surface of the roof, and a second flange projecting forwardly from said vertical planar portion and away from the edge of the roof, said second flange extending along the length of the anchor bar, and said second flange being located intermediate said upper edge portion and said lower edge portion, and said second flange including an upper surface adapted to support a lower edge of an elongated support plate, and means for securing the elongated membrane anchor bar to the vertical surface of the edge of the roof, the means for securing including a fastener adapted to extend through the vertical planar portion of the anchor bar into the edge of the roof.

2. Apparatus for securing a rubber membrane to a roof, the roof having an upper surface and the edge of the roof defining a generally vertical surface, the rubber membrane being supported by the upper surface of the roof, and a portion of the membrane extending downwardly adjacent the vertical surafce of the edge of the roof, the apparatus comprising:

a membrane anchor assembly adapted to be secured to the vertical surface of the edge of the roof and to clamp the rubber membrane against the upper surface of the roof and against the vertical surface of the edge of the roof, the membrane anchor assembly including a first elongated anchor member having a generally planar vertical portion adapted to engage the portion of the rubber membrane extending downwardly adjacent the vertical surface of the edge of the roof and to secure it against the vertical surface of the edge of the roof, the generally planar vertical portion of the anchor member extending downwardly from the upper surface of the roof and positioned in adjacent facing relation to the vertical surface of the edge of the roof, the generally planar vertical portion having a generally planar rearward surface and a forward surface and a first flange projecting rearwardly from the planar rearward surface, the first flange being integrally and rigidly connected to the planar vertical portion of the elongated anchor member, and the first flange including a generally planar downwardly facing lower surafce adapted to engage a planar upper surface portion of the rubber membrane support by the upper surface of the roof to hold the rubber membrane down against the upper surface of the roof, a second flange projecting forwardly from the planar vertical portion, said second flange including an upper surface, a support plate including a generally vertical plate portion adapted to be position in face-to-face relation with said forward surface of said vertical planar portion of said anchor member, said support plate including a lower edge supported on said upper surface of said second flange, and means for securing said support plate against the anchor member and for clamping the anchor member against the rubber membrance.

3. Apparatus as set forth in claim 2 wherein the elongated anchor member has an upper edge and wherein said first flange is integrally joined to said upper edge and extends rearwardly therefrom.

4. Apparatus as set forth in claim 2 wherein the support plate includes an upper edge portion wherein the anchor member includes a lower edge, and further including a cover plate adapted to releaseably clampingly engage the anchor assembly, the cover plate having an upper edge adapted to extend over the upper edge portion of the support plate so as to releaseably grip the support plate, and a lower edge adapted to resiliently engge the lower edge of the anchor member.

5. Apparatus as set forth in claim 2 wherein said first elongated anchor member and said support plate include aligned bores, and wherein said means for securing includes at least one fastener extending through the support plate and the first elongated anchor member into the edge of the roof.

6. Apparatus as set forth in claims 2 wherein said support plate includes an upper portion extending upwardly with respect to the upper surface of the roof, said upper portion providing means for retaining gravel supported on said rubber membrane.

7. Apparatus as set forth in claim 2 wherein the rubber membrane supports weights used to hold the rubber membrane down against the upper surface of the edge of the roof, wherein said support plate includes means for preventing the weights adjacent the edge of the roof from upward movement away from the rubber membrane including a third flange projecting from said upper portion of the support plate and rigidly connected to the planar vertical portion, the third flange extending generally parallel to the first flange, and the third flange being adapted to extend over at least a portion of at least one of the weights such that said portion is housed beneath said third flange and is prevented from upward movement away from the roof.

* * * * *